United States Patent [19]

Saeki et al.

[11] Patent Number: 4,749,418

[45] Date of Patent: Jun. 7, 1988

[54] CHROMATE COATING OF ZINC SURFACES

[75] Inventors: Kenshi Saeki, Yokohama; Kazuyuki Ohyama, Ichikawa; Iwao Kawasaki, Tokyo, all of Japan

[73] Assignee: Nihon Parkerizing Co., Ltd., Tokyo, Japan

[21] Appl. No.: 894,595

[22] Filed: Aug. 8, 1986

[30] Foreign Application Priority Data

Sep. 5, 1985 [JP] Japan ..... 60-194940

[51] Int. Cl.[4] ..... C23C 22/33

[52] U.S. Cl. ..... 148/6.16

[58] Field of Search ..... 148/6.16

[56] References Cited

U.S. PATENT DOCUMENTS

| | | | |
|---|---|---|---|
| 3,076,734 | 2/1963 | Schemkur | 148/6.16 |
| 3,382,111 | 5/1968 | Tongyai | 148/6.16 |
| 3,562,011 | 2/1971 | Hirst | 148/6.16 |

*Primary Examiner*—Sam Silverberg

*Attorney, Agent, or Firm*—Arthur E. Kluegel

[57] ABSTRACT

A chromate composition and process provide improved corrosion resistance and paint adhesion for zinc surfaces. The aqueous acidic composition contains hexavalent and trivalent chromium phosphate and fluorozirconate at prescribed concentrations. The composition is applied and dried without rinsing to yield a chromium coating weight of 10–200 mg/m$^2$.

8 Claims, No Drawings

CHROMATE COATING OF ZINC SURFACES

BACKGROUND OF THE INVENTION

The invention concerns chromate coating compositions for steel sheets which have a zinc based plating.

Chromate coating compositions in which chromic acid or a dichromate salt is dissolved in water and which are suitable for use on the surface of steel sheets which have a zinc based plating are known as a means of providing anti-rust properties and as undercoatings for painting.

These chromate coating compositions do not require the zinc plated steel sheet to be washed with water after coating and they are comparatively simple to use. Moreover they are inexpensive and provide excellent corrosion resistance and for these reasons they are widely used.

However when a conventional chromate coating composition consisting of an aqueous solution of chromic acid or a dichromate salt is used on a steel sheet which has a zinc based plating it is possible to obtain a film which is adequate in terms of corrosion resistance with a fresh composition but as the bath is used over a period of time in the chromate coating process it is affected by the presence of the zinc which is dissolved into the composition and the trivalent chromium which is formed by reduction so that the performance of the aged chromate composition becomes poor and films which have a lower level of performance than that obtained with a fresh composition are formed. Hence the chromate coating composition has to be discarded and replenished frequently in order to achieve a level of performance similar to that attained with a fresh solution and this is undesirable from the point of view of operability and from the point of view of avoiding pollution.

Furthermore when painting is to be carried out the chromate films have poorer paint binding properties than those attainable with a phosphate film and there is also some paint selectivity and so adequate testing must be carried out before painting.

This invention is intended to provide chromate coating compositions which are superior to the conventional chromate coating compositions in respect of their corrosion resistance and paint undercoating properties when forming films on steel plates which have a zinc based plating.

SUMMARY OF THE INVENTION

The distinguishing features of the chromate coating compositions with which the aims of the invention are achieved are that they consist of an acidic aqueous solution which contains 10–100 grams/liter of chromic acid, 1–21 grams/liter of trivalent chromium ion, 0.1–4 grams/liter of phosphate ion and 0.1–4 grams of fluorozirconate ion and that the solution is prepared in such a way that in the said acidic aqueous solution the ratio by weight of hexavalent chromium/trivalent chromium is from 1.5/1 to 5/1, the ratio by weight of chromic acid/fluorozirconate ion is from 5/1 to 100/1 and the ratio by weight of the phosphate ion/fluorozirconate ion is from 1/2 to 2/1.

It is also possible to obtain films which have superior corrosion resistance and superior paint binding properties on the surface of steel sheets which have a zinc based plating by adding silica at the rate of 0.1–200 grams/liter to these chromate coating compositions.

DETAILED DESCRIPTION OF THE INVENTION

The chromic acid in the chromate coating compositions of this invention may be obtained for example by adding anhydrous chromic acid and the trivalent chromium can be added as a salt or conveniently obtained by adding a reducing agent such as oxalic acid, tannic acid, starch, alcohol, hydrazine, citric acid to this solution thereby converting $Cr^{+6}$ or $Cr^{+3}$. The phosphate ion is obtained, for example, by the addition of normal phosphoric acid, ammonium phosphate and the fluorozirconate ion is added for example in the form of $ZrF_6$ and $(NH_4)_2ZrF_6$, $H_2ZrF_6$. The silica may be introduced by the addition of colloidal silica.

If the chromic acid concentration of the chromate coating composition of this invention is less than 10 grams/liter the deposit of a satisfactory quantity of film for achieving the aim of the invention cannot be assured while if the concentration is in excess of 100 grams/liter the quantity of film formed is too great and the adhesion of paint is adversely affected.

If the trivalent chromium concentration of the chromate coating composition is less than 1 gram/liter the film which is formed is such that a large amount of chromium is dissolved out of the film on washing with water or on subjecting the material to an alkaline degreasing treatment and paint selectivity is very great. If the trivalent chromium concentration exceeds 21 grams/liter the trivalent chromium is retained in the coating composition and difficulties arise with precipitation. The ideal hexavalent chromium/trivalent chromium weight ratio from the point of view of the chromate film which is formed on the surface of a steel plate which has a zinc based plating is limited to the range 1.5–5/1, and if this ratio is less than 1.5/1 a large amount of chromium will dissolve out of the film which is formed on water washing or during alkaline degreasing treatments and the paint selectivity will be very great. If on the other hand the value of this ratio is greater than 5/1 the corrosion resisting properties of the film which is formed are adversely affected. By setting the hexavalent chromium/trivalent chromium weight ratio within the range 1.5/1–5/1 there are no irregularities in the film, the chromium fixing rate is high and it has an autoreparative action and moreover under these conditions a chromate film which has little paint selectivity can be formed on the surface of steel sheet which has a zinc based plating.

Moreover phosphate ions and fluorozirconate ions are added to the chromate coating composition in order to maintain and improve performance. Thus a film which has a uniform appearance and superior paint adhesion properties is obtained as a result of the addition of 0.1–4 grams/liter of phosphate ion. If the phosphate ion concentration is less than 0.1 grams/liter it has little effect and if the concentration exceeds 4 grams/liter the film has a high phosphate content and this has an adverse effect on corrosion resistance. The addition of fluorozirconate ion results in a suitable degree of etching of the surface which is to be coated and replacement of the metal ions by complex compounds and in this way it is possible to form chromate films which have superior adhesion properties over long periods of time. The effect of the fluorozirconate ion is slight at concentrations of less than 0.1 grams/liter and if the fluorozirconate ion concentration exceeds 4 grams/liter the surface which is to be coated is over-etched, zinc is rapidly dissolved out into the chromate coating composition and this not only shortens the useful life of the bath but also reduces the corrosion resistance. The ratio by weight of the phosphate ion/fluorozirconate ion in the chromate coating composition is set at 1/2–2/1 and if this ratio is less than 1/2 or greater than 2/1 a film of which the corrosion resistance after painting is poor is obtained and a film which has the intended purpose is not obtained. Furthermore the ratio by weight of the chromic acid/fluorozirconate ion is set at 5/1–100/1 and preferably at 10/1–40/1 and if the value of this ratio is less than 5/1 or more than 100/1 a film of which the corrosion resistance after painting is poor is obtained and it is not possible to obtain a film which has the intended performance.

Corrosion resistance and paint adhesion are still further improved by the addition of 0.1–200 grams/liter of silica to the chromate coating composition of this invention. If less than 0.1 gram/liter of silica is added the addition cannot be expected to have much effect and if more than 200 grams/liter of silica is added the weight of coated film becomes excessive and paint adhesion is reduced. If the performance after painting is taken into consideration then the appropriate amount of silica added is such that the ratio by weight of chromic acid/silica is 10/1–1/2.

The chromate coating compositions of this invention are coated onto steel plates which have a zinc based plating and then dried without water washing and painted. The presence of substantial amounts of alkali metals is undesirable and the compositions are thus preferably used in the form of acidic aqueous solutions. The preferred pH of the compositions is 0.6–4.

The method of using the chromate coating compositions generally involves the steps of degreasing→water washing→chromate coating→drying. The chromate coating composition is used at a temperature within the range of room temperature −50° C. and roll coating, spraying or dipping can be used for the coating process. Immediately after coating any excess material is removed for example by means of a roller. The chromate coating composition is applied to the steel sheet which has a zinc based plating at the rate of 10–200 mg/m$^2$, and preferably at the rate of 15–100 mg/m$^2$, as chromium. The excess chromate coating composition which is removed is recovered and reused.

Coating is carried out continuously and so zinc is dissolved out into the chromate coating composition and, depending on the balance between the amount of dissolved out zinc and the amount of composition which is dragged out, this has a considerable effect on the performance of the chromate film which is formed. In cases where the amount of zinc dissolved out is considerable or the amount of composition which is being dragged out is small, steps must be taken to control the amount of zinc which is present in the coating composition. Auto-draining and ion exchange methods can be used for example for this purpose.

EXAMPLES 1 AND 2; REFERENCE EXAMPLES 1–4

An oiled molten zinc plated steel sheet was treated using the process alkali degreasing→water wash→squeeze rolling→roll coating with chromate treatment composition at room temperature→drying. The content of the chromate coating compositions used were as shown in Table 1 and the performances of the treatment films were as shown in Tables 2 and 3.

TABLE 1

| | Chromate Coating Composition | | | | | |
|---|---|---|---|---|---|---|
| | Example | | Reference Example | | | |
| Component g/l (water) | 1 | 2 | 1 | 2 | 3 | 4 |
| $CrO_3$ | 12.6 | 12.6 | 12.6 | 12.6 | 12.6 | 12.6 |
| $Cr^{3+}$ (Product of ethanol reduction) | 1.8 | 1.8 | — | 1.8 | 1.8 | — |
| $PO_4^{3-}$ (Phosphoric acid) | 0.9 | 0.9 | — | 0.9 | — | 0.9 |
| $ZrF_6^{2-}$ ($H_2ZrF_6$) | 0.7 | 0.7 | — | — | 0.7 | 0.7 |
| $SiO_2$ (silica sol) | — | 9.0 | — | — | — | — |

TABLE 2

| Chromate Coating Composition | Amount of Chromium Deposited (mg/m$^3$) | Salt-Spray Corrosion Resistance % Rust *7 | | Paint Adhesion (*1, 6) | | | | Corrosion Resistance Painted *5 |
|---|---|---|---|---|---|---|---|---|
| | | | | Checker | Erikson | Impact *4 | | Max. Peel |
| | | 48 H | 72 H | *2 | *3 | Front | Back | Width mm |
| Example 1 | 20–25 | 0 | 5 | 4 | 3 | 2 | 1 | 1.1 |
| Example 2 | | 0 | 2 | 5 | 5 | 5 | 4 | 0.9 |
| Ref. Example 1 | | 60 | 80 | 4 | 3 | 2 | 1 | 3.6 |
| Ref. Example 2 | | 30 | 60 | 4 | 3 | 2 | 1 | 2.4 |
| Ref. Example 3 | | 15 | 40 | 4 | 3 | 2 | 1 | 1.8 |
| Ref. Example 4 | | 5 | 20 | 4 | 3 | 2 | 1 | 1.2 |

*1 Melamine alkyd based paint (25μ)
*2 Transparent tape stripped off after cutting into a checkerboard pattern of 10 × 10 squares of side 1 mm.
*3 Transparent tape stripped off after pushing out 7 mm.
*4 Transparent tape stripped off after dropping a punch of ½ inch diameter with a load of 1 kg from a height of 30 cm.
*5 Tape was stripped from the cross-cut part after a 144 hour salt spray test and the maximum width of peeling on the side was measured.
*6 Paint adhesion evaluation standards:
5: No peeling at all on stripping tape after working.
4: Less than 10% peeling on stripping tape after working.
3: 11–30% peeling on stripping tape after working.
2: 31–50% peeling on stripping tape after working.
1: 51% or more peeling on stripping tape after working.
*7 Area of rusting after salt spray test.

The treatment was continued in Example 1 and Reference Example 1 in order to investigate the effect of the zinc which was dissolved out into the chromate coating composition on the corrosion resistance and the results obtained were as shown in Table 3.

TABLE 3

| Chromate Coating Composition | Zinc Content of Chromate Coating Composition (g/l) | Corrosion Resistance Salt Spray % Rust | |
|---|---|---|---|
| | | 48 H | 72 H |
| Example 1 | 0 | 0 | 5 |

TABLE 3-continued

| Chromate Coating Composition | Zinc Content of Chromate Coating Composition (g/l) | Corrosion Resistance Salt Spray % Rust 48 H | 72 H |
|---|---|---|---|
| | 1.0 | 0 | 5 |
| | 2.0 | 0 | 2 |
| | 3.0 | 2 | 5 |
| | 4.0 | 10 | 15 |
| Reference | 0 | 45 | 80 |
| Example 1 | 0.5 | 70 | 100 |
| | 0.8 | 100 | 100 |
| | 1.2 | 100 | 100 |

EXAMPLE 3

An oiled molten zinc plated steel sheet was treated using the process alkali degreasing→water wash→squeeze rolling→roll coating with chromate treatment composition at room temperature→drying. The concentration of the chromate coating composition and the amount of chromium deposited in the film was varied as indicated in Table 4. The results obtained in subsequent corrosion resistance tests are also shown in Table 4.

TABLE 4

| Chromate Coating Composition Components (g/l) | | | | Amount of Chromium Deposited | Salt Spray Corrosion Resistance % Rust | |
|---|---|---|---|---|---|---|
| $CrO_3$ | $Cr^{3+}$ | $PO_4^{3-}$ | $ZrF_6^{2-}$ | ($mg/m^2$) | 48 H | 72 H |
| 8.6 | 1.2 | 0.6 | 0.5 | 15 | 2 | 10 |
| 12.6 | 1.8 | 0.9 | 0.7 | 22 | 0 | 5 |

TABLE 4-continued

| Chromate Coating Composition Components (g/l) | | | | Amount of Chromium Deposited | Salt Spray Corrosion Resistance % Rust | |
|---|---|---|---|---|---|---|
| $CrO_3$ | $Cr^{3+}$ | $PO_4^{3-}$ | $ZrF_6^{2-}$ | ($mg/m^2$) | 48 H | 72 H |
| 18.9 | 2.7 | 1.3 | 1.1 | 33 | 0 | 5 |

What is claimed is:

1. An aqueous acidic chromate coating composition for steel sheets which have a zinc based plating comprising 10–100 grams/liter of chromic acid, 1–21 grams/liter of trivalent chromium ion, 0.1–4 grams/liter of phosphate ion and 0.1–4 grams of fluorozirconate ion and that the solution is prepared in such a way that in the said acidic aqueous solution the ratio by weight of hexavalent chromium trivalent chromium is from 1.5/1 to 5/1, the ratio by weight of chromic acid/fluorozirconate ion is from 5/1 to 100/1 and the ratio by weight of the phosphate ion/fluorozirconate ion is from 1/2 to 2/1.

2. The composition of claim 1 additionally comprising 0.1–200 g/l of silica.

3. The composition of claim 1 which is substantially free of alkali metal ions.

4. The composition of claim 3 wherein the weight ratio of chromic acid/fluorozirconate ion is from 10/1 to 40/1.

5. The composition of claim 2 wherein the weight ratio of chromic acid/silica is from 10/1 to 1/2.

6. The composition of claim 1 wherein the pH value of the composition is from 0.6 to 4.0.

7. The process for applying a chromate coating to a zinc surface comprising contacting the surface with the composition of claim 1 and drying the resulting coating without rinsing.

8. The process of claim 7 wherein the composition is applied in an amount sufficient to yield 10–200 $mg/m^2$ of chromium in the dried coating.

* * * * *